United States Patent [19]

Black

[11] 3,980,017

[45] Sept. 14, 1976

[54] STENCIL SCREEN COATING APPARATUS

[76] Inventor: James A. Black, 13700 Sparta Ave., Kent City, Mich. 49501

[22] Filed: Oct. 31, 1974

[21] Appl. No.: 519,539

[52] U.S. Cl. ..... 101/129; 101/120; 101/123; 101/124; 118/406

[51] Int. Cl.[2] ..... B41F 15/42; B41F 15/44

[58] Field of Search ..... 101/114, 115, 116, 119, 101/120, 122, 123, 124; 118/213, 406; 15/256.5, 256.51

[56] References Cited

UNITED STATES PATENTS

| | | | |
|---|---|---|---|
| 3,564,996 | 2/1971 | Barros | 101/124 X |
| 3,796,153 | 3/1974 | Jaffa | 101/119 X |
| 3,811,378 | 5/1974 | Bohm | 101/119 X |

FOREIGN PATENTS OR APPLICATIONS

| | | | |
|---|---|---|---|
| 266,757 | 3/1968 | Austria | 101/120 |
| 878,094 | 9/1961 | United Kingdom | 101/123 |
| 768,623 | 2/1957 | United Kingdom | 101/123 |

*Primary Examiner*—Edgar S. Burr
*Assistant Examiner*—R. E. Suter
*Attorney, Agent, or Firm*—Price, Heneveld, Huizenga & Cooper

[57] ABSTRACT

In a stencil screen printing system, submersion transfer apparatus for forcing fluid through the pattern screen, including an elongated member with downwardly depending end supports having therebetween a strand submersed in the coating fluid e.g. printing ink. The elongated member is fitted in place of the conventional squeegee on a stencil screen press, so that the submerged strand is positioned in contact with the upper surface of the stencil screen during the print stroke to force fluid such as ink through the pattern of the mesh screen.

8 Claims, 12 Drawing Figures

STENCIL SCREEN COATING APPARATUS

BACKGROUND OF THE INVENTION

The present invention relates to stencil screen coating, usually for printing, and particularly to a submersion fluid transfer device to force fluid through the screen onto the underlying surface or substrate to be printed.

Screen stencilling is widely used for selectively depositing coating materials such as inks, adhesives, and other functional and/or decorative fluids through the pattern areas of a screen stencil onto underlying stock such as paper, polymers, cloth, wood, laminates, and the like, for making posters, decalcomania, graphic designs, and other purposes. The stock can be in various forms including sheet or web forms. Since screen stencilling is most commonly used for printing of inks, this invention will largely be explained with this usage for illustrative purposes.

Conventional squeegees are generally fabricated with a support plate and a resilient blade held in contact with a movable printing screen above print stock, such that, as relative motion is caused between the screen and squeegee, ink is forced through the screen by the squeegee to form a print on the stock. The ink or other fluid typically includes a fairly volatile carrier or solvent to be evaporated from the stock after the coating or printing step. Sometimes, however, the medium is temporarily placed in a fluid condition to allow printing thereof, after which it cools to a nonfluid state.

Specifically, in the conventional stencil printing process, a thin layer of ink is spread on the stencil screen, then the squeegee blade used to wipe the ink ahead of it on the screen while forcing a portion of the ink down through the mesh of the screen onto the stock. The screen is then recoated, and the process repeated. Ink must be repeatedly supplied to the screen between print strokes to provide sufficient ink for the operation. During the print stroke, the squeegee blade shifts the ink to an extreme end of the screen. A flow coater or the like then respreads the ink for another print stroke. This repeated shifting and respreading of the ink causes evaporation of the solvent or carrier of the ink, with consequent thickening and drying of the ink on the stencil screen. The amount of ink which can be applied to the screen at any one time is limited since, if a substantial amount of ink were applied, the squeegee would gush the ink over the edge of the frame at the end of the print stroke.

Thus, although a conventional squeegee works well in providing prints, the tasks of supplying adequate ink, and of maintaining uniform quality become a problem, particularly in a high speed screen press.

SUMMARY OF THE INVENTION

An object of the present invention is to provide a stencil screen transfer apparatus eliminating the necessity of constant fluid resupply, of flow coating after each print stroke, of rapid viscosity changes in the fluid, and drying of the fluid on the screen. The present invention employs an ink transfer member which is a taut strand or an element submerged in a reservoir of ink retained in the stencil frame, positioned in contact with the printing screen during the print stroke to controllably force the fluid through the screen and onto stock therebelow. The ink submerging the strand is not forced ahead of the strand to gush over the stencil frame since the strand presents a relatively small cross-sectional area moving beneath the level of the ink. As a small amount of ink is transferred through the stencil screen, the remaining ink flows over the strand to remain evenly spread over the screen. No flow coating mechanism is required.

In addition to solving the above noted problems encountered with conventional squeegees, the submersion strand employed in the present invention can, in one embodiment, be a resistance wire which can be heated and used with thermoplastic inks normally in a solid or semisolid form at room temperature, but fluid when heated. Thus, the heated wire serves both as an ink forcing or transfer member and also as a heating medium for thermoplastic inks.

Apparatus embodying the present invention includes an elongated mount and downwardly depending support members at least at the opposite ends thereof. The transfer member, having at least one smooth screen engaging surface, is attached at opposite ends of the elongated mount between the downwardly depending support members remote i.e., spaced below the mount.

In one embodiment, the elongated member supports a pair of substantially parallel spaced forcing members. In another embodiment, the strand is a resistance wire insulated from the support member, with electrical terminals provided for coupling the resistance wire to a source of electrical power. In another embodiment, the submersion member is polymeric, e.g. of rubber, polyvinyl chloride, polypropylene, or other resilient equivalents.

These and other objects and features of the present invention will become apparent upon reading the following specification together with the drawings.

DETAILED DESCRIPTION OF THE PREFERRED EMBODIMENTS

Figure 1:
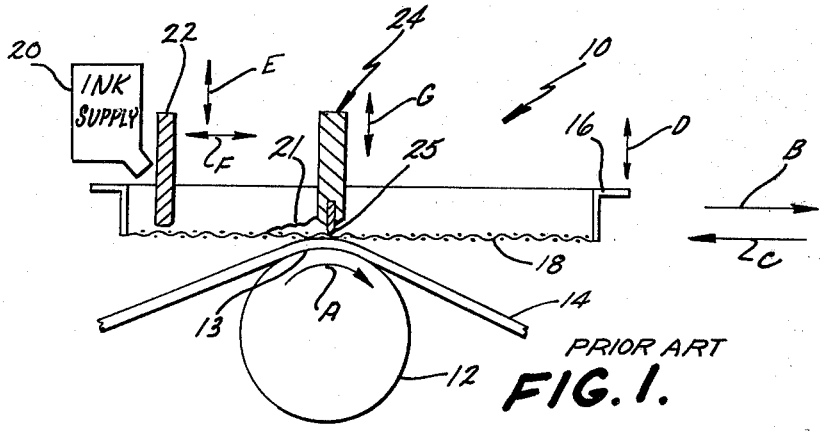
PRIOR ART FIG. 1.
FIG. 1 is a fragmentary side elevational view in schematic form of a printing station for a screen printing web press employing a conventional squeegee and flow coater showing the various components associated therewith.

Referring now to FIG. 1, the structure there shown is a web screen printing press of the type described in copending application entitled PRINTING PRESS AND WEB REGISTRY SYSTEM filed on Mar. 20, 1972, Ser. No. 236,482, issued Dec. 25, 1973 as U.S. Pat. No. 3,780,652, assigned to the present assignee, and incorporated herein by reference. In the system shown in FIG. 1 each printing station 10 includes a print cylinder 12 forming a stock support. The cylinder rotates in the direction indicated by arrow A during the print stroke of each cycle of operation. The web printing stock 14 advances with the cylinder. Above the print cylinder 12 there is positioned a stencil screen frame 16 which supports a printing screen 18 having a desired printing pattern formed therein for making a print. The screen frame 16 is reciprocated horizontally by suitable typical carriage means (not shown) to move in a direction indicated by arrow B during the print stroke at the same speed as the web passes over the print cylinder 12. The screen is raised (arrow D) and moved rearwardly as indicated by arrow C during the return stroke. The screen is shown in FIG. 1 midway through a print stroke and moving forwardly. Ink is periodically supplied to the screen by a suitable ink supply 20. Also provided as part of the inking system is a flow coater 22 which spreads the ink for the next print stroke.

During the print stroke, the flow coater, as described in the above-identified copending application, is raised above the screen. During the return stroke, the flow coater is lowered near the screen to spread the ink on the screen. The conventional squeegee 24 with its blade 25 is fitted into a holder (not shown) for vertically moving the squeegee as indicated by arrow G. During the return stroke, the squeegee is raised above the screen while at the beginning of the print stroke, the squeegee is lowered into contact with the screen for the print stroke. As seen in FIG. 1, during the print stroke, ink 21 from supply 20 is forced ahead of the leading edge of squeegee blade 25 as the screen advances in contact with the lower edge of the blade, while a small portion is forced through the screen. The volume of ink which can be supplied to the screen at a given time is limited, or else the excess will be slopped over the end of the stencil screen frame.

The submersion ink transfer device of the present invention is employed in place of the conventional squeegee 24 shown in FIG. 1. The flow coating apparatus 22 is eliminated. The remaining apparatus is employed.

Figure 2:
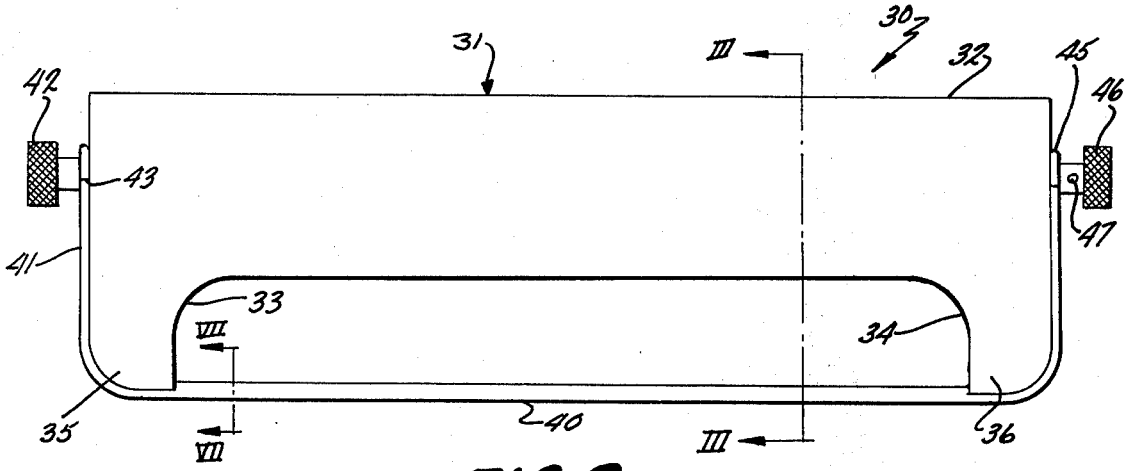
FIG. 2 is a front elevation view of the submersion ink transfer member embodying the present invention.
Figure 3:
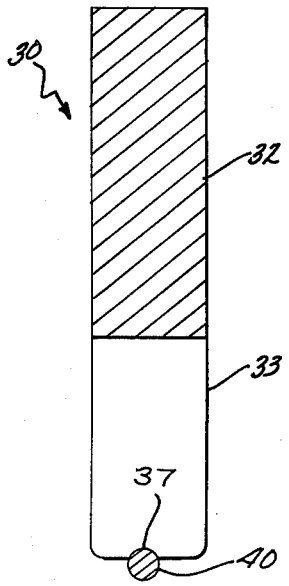
FIG. 3 is a cross-sectional view of the member shown in FIG. 2 taken along the lines III—III of FIG. 2.

Referring to FIGS. 2 and 3, submersion embodiment 30 comprises a generally elongated mount 31 having a main body 32 with spaced downwardly depending end support members 33 and 34. The bottom surfaces 35 and 36 of end supports 33 and 34, respectively, include a semicircular recessed seat 37 formed therein for receiving a submersion strand or rod 40. In the preferred embodiment, strand 40 comprises a wire tautly strung between the end support members 33 and 34 and positioned in the recessed seats 37 (FIG. 3). Seat 37 extends along the center of the support members 33 and 34 and upwardly around the curved ends of the support members. The cross-sectional configuration of strand 40 need not be circular or solid, it being required only that the surface contacting the screen be relatively smooth and preferably slightly curved adjacent the screen.

One end 41 of wire 40 is secured to the support as by winding it around a post 42 anchored in the body 32 as seen in FIG. 2. Post 42 includes an aperture 43 in the shank thereof to receive the end of the wire and fasten the wire thereto. The opposite end 45 of wire 40 is similarly attached to post 46 in the body. Post 46 also includes a wire fastening aperture 47.

Wire 40 may vary in diameter from 1/16 inch to ⅛ inch or greater and can be made of any suitable durable material such as hardened steel, stainless steel or the like. Although the end support members 33 and 34 are integrally formed from a steel plate in the preferred embodiment, the supports can be separately formed and secured to the body as long as they provide suitable strength for tautly stretching wire 40 therebetween.

The ink transfer member can range in length to accommodate various size screens, but is most suitable for small width screens. It is possible to extend its length by increasing the diameter of wire 40. Additionally, if desired, intermediate support posts can be positioned between end supports 33 and 34. It is desirable, however, to minimize the spacing of the end supports 33 and 34 as well as any intermediate supports to reduce the drag when moved through the supply of ink and to minimize stress tending to distort the element. The mount is installed in a conventional squeegee holding apparatus, to hold the structure in alignment with the crown of the printing cylinder and to move it vertically with the printing screen frame when the frame is lifted clear of the cylinder and stock thereon. The operation is illustrated in FIG. 4, now discussed.

Figure 4:
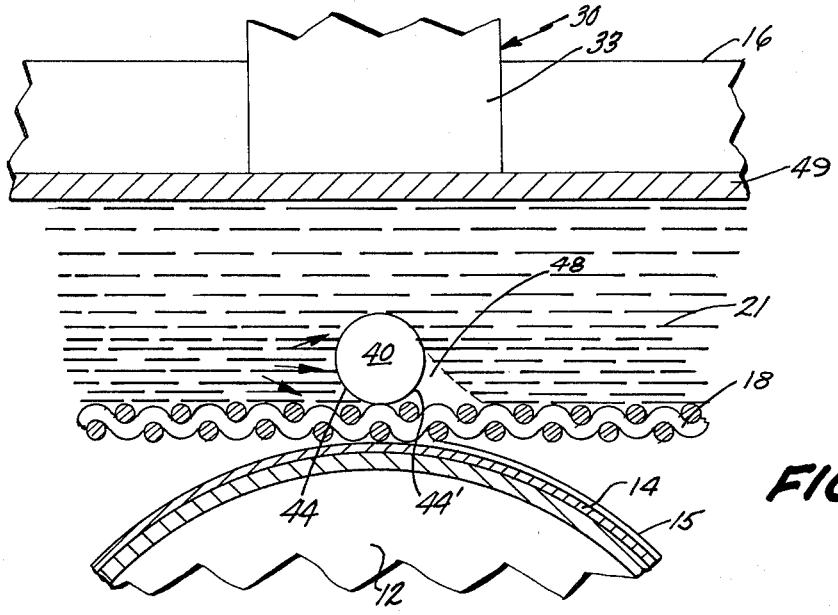
FIG. 4 is an enlarged fragmentary cross-sectional view of the member shown in FIG. 3 mounted in a printing station and taken through the center of the member, illustrating the operation of the apparatus during a printing stroke.

In the enlarged cross sectional view of FIG. 4, a pool of ink 21 is shown supplied and retained within the reservoir formed by the stencil frame, on the printing screen, to completely submerge transfer member 40. The upstanding walls of the frame retain the ink pool in the reservoir. The weave of the screen 18 is selected relative to the ink viscosity used, to prevent the ink from flowing down through it until additional force from member 40 is applied. This can readily be determined by those in the art, in a fashion like that used conventionally to prevent ink dripping through the screen. As the screen 18 and stock 14 on cylinder 12 are advanced beneath wire 40, the forward, curved leading surface 44 of wire 40 forces a small portion of the ink downwardly through the open stencil areas of the screen in a controlled manner to form the desired printing pattern 15 on web stock 14. By increasing or decreasing the diameter of wire 40, more or less ink can be forced through the screen as desired because of the greater or lesser amount of wire surface oriented downwardly to control the increment of ink upon which the downward thrust is applied. As relative motion occurs between wire 40 and the screen, pocket 48 of relatively lower pressure is formed at the trailing edge 44′ of wire 40 and tends to draw the excess ink flowing over the wire downwardly to recoat the screen behind the wire. The depth of the ink pool is kept greater than the vertical height of member 40, and is usually about 1 inch or so. This flow of the excess ink over the top of the element to recoat the surface of the screen thereby eliminates the necessity of a flow coater, and permits the pool of ink to be retained in the frame, in contrast to a mere thin layer or coat to be squeezed off and respread as in the conventional apparatus. This arrangement also permits an optional vapor-retaining cover 49, shown in FIG. 4, to substantially cover the screen frame 16 and ink pool 21 when the screen is not in use. This almost eliminates the usual clean up and associated difficulties generally incurred between printing orders employing a particular screen.

Figure 5:
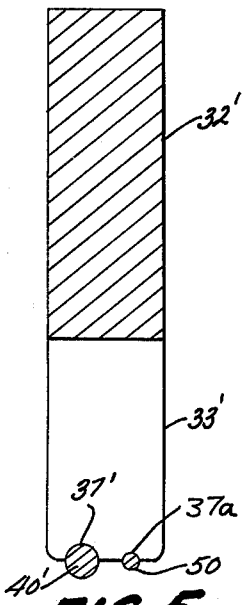
FIG. 5 is a cross-sectional view of a first alternative embodiment of the present invention employing two wires.
Figure 6:
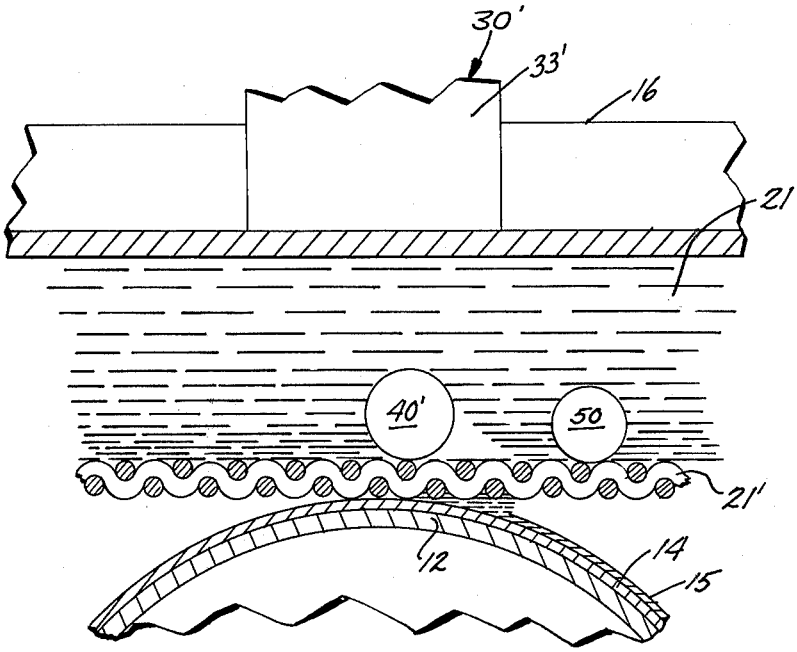
FIG. 6 is a greatly enlarged fragmentary cross-sectional view of the ink forcing member shown in FIG. 5, mounted in a printing station and taken through the center of the member, illustrating the operation of the apparatus during a printing stroke.

An alternative embodiment of the present invention is shown in FIG. 5. Submersion transfer embodiment 30' has a pair of taut wires 40' and 50 which extend across between end support members (only one of the like members 33' being shown in the figure), held in recessed seats 37' and 37*a*. The wires are suitably attached to the side walls of body 32' in the same manner as that illustrated in FIG. 2. Wires 40' and 50 may be of substantially the same diameter or, as illustrated in FIG. 5, the leading wire 40' is preferably somewhat larger in diameter. The lower surface of the trailing element is slightly elevated relative to that of the leading element and the screen. The relative dimensions of these wires are not critical. The leading wire forcibly contacts the screen during the printing stroke and is countered by the resistive force of the printing cylinder and, therefore, must be relatively strong so as not to significantly bow or bend. The wires are substantially parallel and spaced apart. During a print stroke the trailing wire 50, as seen in FIG. 6, preflows ink 21' into the weave of the screen elements forming the print pattern. This permits faster operation of the screen printing press during the print stroke, since at least a portion of the ink to form the print already fills the mesh of the screen, and is readily discharged with the downward entrance of more ink into the mesh under the influence of wire 40'. The spacing between wires 40' and 50 can range from slightly under ½ inch to 1 inch or more depending upon the particular ink viscosity employed, although 1 inch is a typical figure. The dual wire arrangement shown in FIGS. 5 and 6 likewise is fully submerged in the pool of ink.

Figure 7:
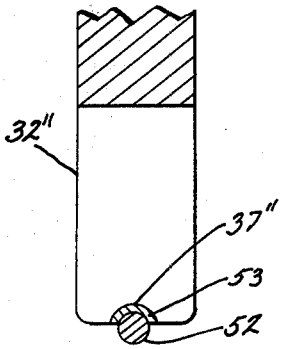
FIG. 7 is a fragmentary enlarged cross-sectional view of a second alternative embodiment of the present invention employing a resistance wire.
Figure 8:
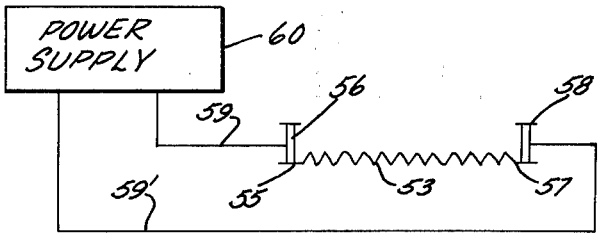
FIG. 8 is an electrical circuit diagram partly in schematic and block form showing the electrical connection of the embodiment shown in FIG. 7.

The ink transfer member can be manufactured of an electrical resistance wire such as nichrome for a printing system employing a thermoplastic ink which is normally a solid, i.e., powdered form at room temperature, or a semisolid e.g. a gel at room temperature, but when heated, converts to a fluid form suitable for printing. Such an arrangement is shown in FIGS. 7 and 8 with nichrome wire 52 supported by the same body and support structure shown in FIGS. 2 and 3. A layer of electrical insulation 53 is positioned between the surface of nichrome wire 52 and the wire receiving seat 37'' formed in the end supports (one support 32'' shown in FIG. 7). Insulator layer 53 may be a nonconducting epoxy polymer or other suitable material which is also heat-resistant to prevent deterioration thereof by the heated nichrome wire 52. In the event the body itself is made of heat-resistant electrically insulative material, the additional insulation 53 is unnecessary.

In the embodiment shown in FIGS. 7 and 8, the opposite ends 55 and 57 of the nichrome wire 52 terminate at posts 56 and 58, respectively, which serve as an electrical connector for coupling conductors 59 and 59' thereto. As seen in FIG. 8, conductors 59, 59' are electrically connected to an electrical power supply 60. Supply 60 provides electrical current to resistance wire 53 sufficient to maintain the temperature surrounding the area adjacent the wire at a value to maintain the thermoplastic ink in a molten form for printing. Posts 56 and 58 can comprise insulated counterparts to posts 42 and 45 (FIG. 2) and serve not only as electrical connectors but also as means for securing the wire to the body. Conductors 59, 59' are flexible and suitably strung between the power supply and the submersion wire element so as not to interfere with any vertical motion of the wire element with its support during operation.

Figure 9:
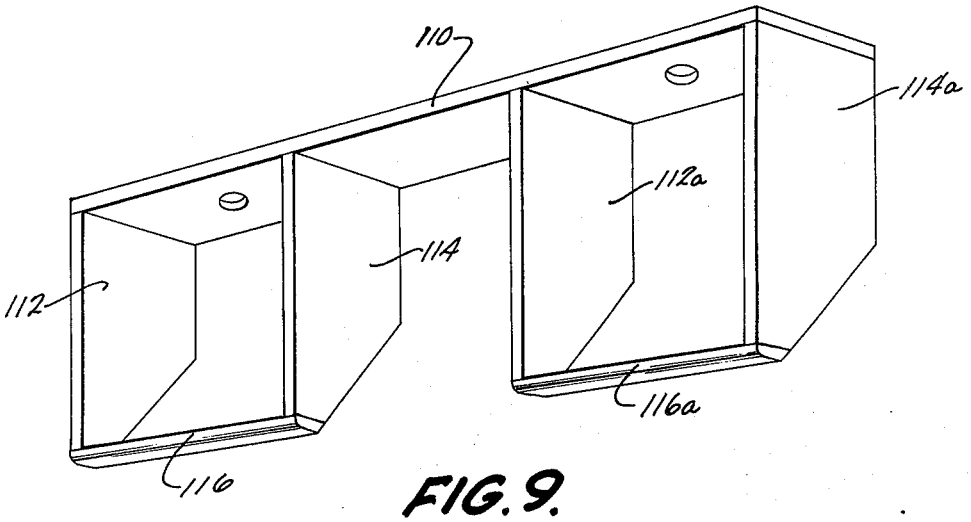
FIG. 9 is a perspective view of a third alternative embodiment employing a polymeric submersion transfer element.
Figure 10:
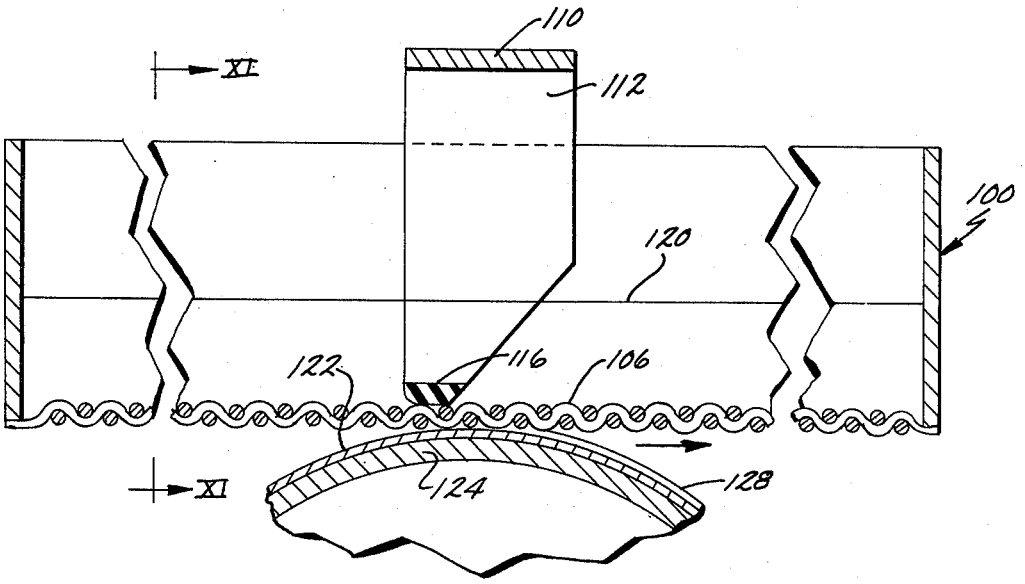
FIG. 10 is an end elevational, sectional view of a stencil screen printing assembly employing the embodiment of FIG. 9.
Figure 11:
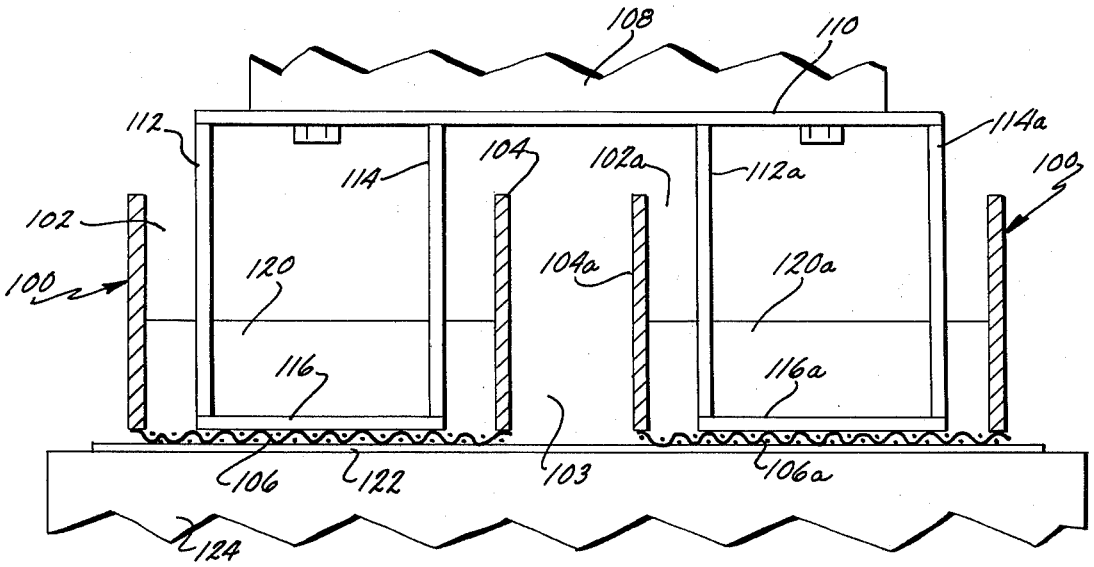
FIG. 11 is an elevational sectional view taken on plane XI—XI of FIG. 10.
Figure 12:
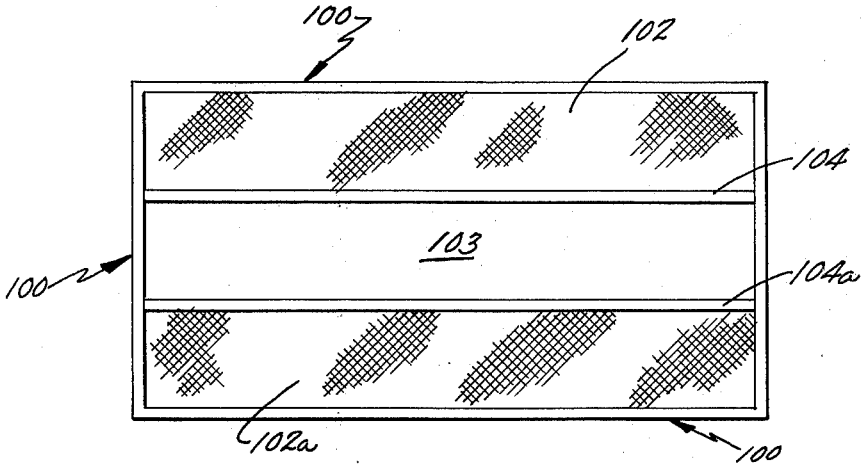
FIG. 12 is a plan view of the stencil screen frame used with the embodiment of FIGS. 9–11.

In FIGS. 9–12 is shown another embodiment wherein each of the submersion elements that cause ink transfer are polymeric, preferably rubber. The length of such elements is purposely kept shorter than when wire is employed, to prevent significant flexing of the intermediate portions of the elements which could result in loss of print quality. If desired, more than one such submersion element is mounted in longitudinally spaced fashion on the same mount as shown, to print more than one zone of the stock simultaneously. In FIGS. 9–11, two such elements are shown so mounted for illustrative purposes.

Specifically, when using two such submersion elements, the rectangular stencil frame 100 is divided to have two print areas 102 and 102*a*, preferably separated by an intermediate zone 103, using partitions 104 and 104*a*. Attached across the bottom of print areas 102 and 102*a* are stencil screens 106 and 106*a*. Holder 108 secures elongated transverse mount 110, from which depend four supports, one pair 112 and 114 for zone 102, and a second pair 112*a* and 114*a* for zone 102*a*. Attached between the lower ends of supports 112 and 114 is submersion ink transfer member 116, and between the lower ends of supports 112*a* and 114*a* is submersion ink transfer member 116*a*. Members 116 and 116*a* engage upper surfaces of screens 106 and 106*a*, respectively, during the print stroke, while submerged beneath respective pools of ink 120 and 120*a* retained in zones 102 and 102*a* by the upstanding walls of stencil frame 100. The print stock 122 beneath the stencils is supported on a stock support 124 such as a print cylinder or the like.

During operation, and specifically during the print stroke, rotation of cylinder 124 advances stock 122 simultaneously with advancement of frame 100, stencil screens 106 and 106*a*, and pools of ink 120 and 120*a*, while transfer members 116 and 116*a* remain stationary above the crest of cylinder 124, causing relative motion therebetween. The tapered, downwardly sloped forward faces of submerged members 116 and 116*a* cause a downward thrust on the increment of ink therebeneath to cause ink transfer down through the mesh of the stencils in a pattern to form a printed layer 128 on the underlying stock, while members 116 and 116*a* engage the moving stencil. Excess ink flows over the top of members 116 and 116*a*. On the return stroke, while the frame returns, the stencil face is elevated off the stock and support cylinder, and the transfer elements are preferably elevated out of engagement with the screens.

It will become apparent to those skilled in the art that various modifications to the present invention can be made. The submersion ink transfer member can, for example, be fabricated of hollow tubing, noncircular rods or other strand-like members in place of the members shown in the illustrated embodiments. The member can be heated directly, as described, or indirectly. If a hollow member is used for example, a heated fluid circulated therethrough can be employed. These and other obvious variations are intended to fall within the scope of the present invention as defined by the appended claims.

The embodiments of the invention in which an exclusive property or privilege is claimed are defined as follows:

1. Submerged squeegee, stencil screen coating apparatus comprising: a stencil screen frame including bottom portions for mounting a stencil screen, and side portions for forming a reservoir for coating fluid in said frame and on the screen; submersion fluid transfer means for forcing a portion of said fluid through the stencil screen while submersed under the fluid, comprising a mount spaced above the stencil screen, an elongated submersion transfer element spaced below said mount to be in contact with the screen, and upstanding support members interconnecting said mount and said submersion transfer element, said support members being spaced from each other to provide fluid flow space therebetween and above said submersion transfer element and thereby allow stencilling fluid in excess of said portion to flow through said space; said submersion transfer element comprising a metal strand.

2. Submerged squeegee, stencil screen coating apparatus comprising: a stencil screen frame including bottom portions for mounting a stencil screen, and side portions for forming a reservoir for coating fluid in said frame and on the screen; submersion fluid transfer means for forcing a portion of said fluid through the stencil screen while submersed under the fluid, comprising a mount spaced above the stencil screen, an elongated submersion transfer element spaced below said mount to be in contact with the screen, and upstanding support members interconnecting said mount and said submersion transfer element, said support members being spaced from each other to provide fluid flow space therebetween and above said submersion transfer element and thereby allow stencilling fluid in excess of said portion to flow through said space; said submersion transfer element comprising a polymeric strand.

3. In a stencil screen printing apparatus, a submersion transfer device for forcing stencilling fluid through the stencil screen comprising: an elongated mount having spaced support members depending from opposite ends thereof to extend down into said stencilling fluid; and a submersion strand having surface areas along the underside thereof to engage the stencil screen and transfer a portion of said stencilling fluid through said stencil screen; said submersion strand extending between said support members and spaced below said mount to be submersed in said stencilling fluid, and to define a space above said strand, below said mount, and between said support members and thereby allow stencilling fluid in excess of said portion to flow through said space.

4. The apparatus as defined in claim 3 wherein said strand comprises a wire segment anchored at opposite ends to said support members.

5. The apparatus as defined in claim 4 wherein said support members include receiving seats formed therein for holding at least a portion of said strand therein.

6. The apparatus as defined in claim 3 and further including a second strand between said support members substantially parallel to and spaced from said first named strand, and having its lower surface above that of said first named strand.

7. A method of stencil screen printing, comprising the steps of: supplying a pool of fluid on a stencil screen; submersing a strand in the pool of fluid across and in contact with the stencil screen; causing relative motion between the strand and the stencil screen while simultaneously retaining printing stock under the stencil screen, to form a coating on the stock as the strand forces a portion of the fluid through the stencil screen onto the stock, and allowing excess fluid in the pool to flow over the strand.

8. The method defined in claim 7 further including the steps of:

extending a second strand across the screen in spaced relationship and substantially parallel to the first strand; and causing relative motion between said second strand and said stencil screen during relative motion of the first strand and the stencil screen, to pre-fill the screen with the fluid for the succeeding print stroke by the first strand.

* * * * *

UNITED STATES PATENT OFFICE

CERTIFICATE OF CORRECTION

Patent No. 3,980,017 Dated September 14, 1976

Inventor(s) James A. Black

It is certified that error appears in the above-identified patent and that said Letters Patent are hereby corrected as shown below:

The term of this patent subsequent to August 10, 1993, has been disclaimed.

Signed and Sealed this Sixteenth Day of November 1976

[SEAL]

*Attest:*

RUTH C. MASON
*Attesting Officer*

C. MARSHALL DANN
*Commissioner of Patents and Trademarks*